US006474397B1

(12) United States Patent
Gunkel et al.

(10) Patent No.: US 6,474,397 B1
(45) Date of Patent: Nov. 5, 2002

(54) FLUXING AGENT FOR METAL CAST JOINING

(75) Inventors: Ronald W. Gunkel, Lower Burrell; Larry L. Podey, Greensburg; Thomas N. Meyer, Murrysville, all of PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/766,023

(22) Filed: Jan. 19, 2001

Related U.S. Application Data

(60) Provisional application No. 60/177,153, filed on Jan. 20, 2000.

(51) Int. Cl.[7] ..... B22D 19/00
(52) U.S. Cl. ..... 164/102; 164/100; 164/98
(58) Field of Search ..... 164/102, 100, 164/98

(56) References Cited

U.S. PATENT DOCUMENTS

| | | | | |
|---|---|---|---|---|
| 3,465,423 A | | 9/1969 | Kiesler et al. | 29/527.3 |
| 4,643,241 A | | 2/1987 | Yonekura et al. | 164/101 |
| 4,687,043 A | | 8/1987 | Weiss et al. | 164/97 |
| 5,171,377 A | * | 12/1992 | Shimizu et al. | 148/23 |
| 5,273,099 A | * | 12/1993 | Takagi et al. | 164/34 |
| 5,293,923 A | | 3/1994 | Alabi | 164/102 |
| 5,333,668 A | | 8/1994 | Jorstad et al. | 164/100 |
| 5,370,171 A | | 12/1994 | Fields et al. | 164/312 |
| 5,429,173 A | | 7/1995 | Wang et al. | 164/75 |
| 5,435,374 A | | 7/1995 | Fishkis et al. | 164/97 |
| 6,286,583 B1 | * | 9/2000 | Rueckert et al. | 164/100 |

FOREIGN PATENT DOCUMENTS

| | | | | |
|---|---|---|---|---|
| JP | 53-39928 | | 4/1978 | 19/8 |
| JP | 63-242459 | * | 10/1988 | 164/102 |

* cited by examiner

*Primary Examiner*—Tom Dunn
*Assistant Examiner*—I. H. Lin
(74) *Attorney, Agent, or Firm*—Julie W. Meder; Gary P. Topolosky

(57) ABSTRACT

A method of joining an aluminum cast member to an aluminum component. The method includes the steps of coating a surface of an aluminum component with flux comprising cesium fluoride, placing the flux coated component in a mold, filling the mold with molten aluminum alloy, and allowing the molten aluminum alloy to solidify thereby joining a cast member to the aluminum component. The flux preferably includes aluminum fluoride and alumina. A particularly preferred flux includes about 60 wt. % CsF, about 30 wt. % $AlF_3$, and about 10 wt. % $Al_2O_3$.

10 Claims, No Drawings

FLUXING AGENT FOR METAL CAST JOINING

RELATED APPLICATION

This application claims the benefit of U.S. Provisional Application Ser. No. 60/177,153 filed Jan. 20, 2000 entitled "Fluxing Agent for Metal Cast Joining".

This invention was made with government support under Contract No. 86X-SU545C awarded by the Department of Energy. The government has certain rights in this invention.

BACKGROUND OF THE INVENTION

1. Field of the Invention

The present invention relates to a fluxing agent for a metal cast/joint, more to a method for flux joining aluminum components in a mold.

2. Prior Art

The fabrication of large aluminum structures has traditionally been in an assembly process wherein an assortment of parts are joined together by welding, riveting, bolting, adhesive bonding or the like. Each of these processes are labor intensive and are often difficult to accomplish for the geometries of certain components. For example, welding of components to form a large structure is problematic because the components must be made to stringent tolerances to ensure proper mating between the components, machining operations to achieve these tolerances must be carefully controlled to achieve consistent component fit and size of the welds. The assembly fixtures, welding power sources and welding process steps are costly.

One alternative to assembling numerous parts has been casting. Casting process have been developed to reduce costs and improve repeatability as well as consistency of the assemblies. Casting processes typically eliminate the number of parts and reduce the assembly steps of fabricating a large structure.

Casting of molten metal onto an extruded aluminum member is disclosed, for example in U.S. Pat. No. 5,273,099. A flux including potassium and fluorine is applied to the extruded aluminum member. Molten aluminum alloy is poured into a mold containing the flux coated aluminum member. Upon solidification, a joint forms between the cast aluminum and the flux coated aluminum member. While potassium and fluoride base fluxes may be used to cast join aluminum components, the strengths of the bonds between the components have been insufficient.

Accordingly, a need remains for a flux for cast joining aluminum components with a metallurgical bond that has the strength of a brazed or soldered joint.

SUMMARY OF THE INVENTION

This need is met by the method of the present invention of joining an aluminum cast member to an aluminum component. The method includes the steps of coating a surface of an aluminum component with flux comprising cesium fluoride, placing the flux coated component in a mold, filling the mold with molten aluminum alloy and allowing the molten aluminum alloy to solidify thereby joining a cast member to the aluminum component. The flux preferably includes aluminum fluoride and alumina. A particularly preferred flux includes about 60 wt. % CsF, about 30 wt. % $AlF_3$, and about 10 wt. % $Al_2O_3$. The flux is preferably coated on the surface to be joined in a thickness of about 5 to 20 g/m$^2$. Prior to placing in a mold, the surface of the component to be coated with flux is roughened to enhance adhesion of flux and metal thereto. Components suitable for use with the present invention include castings, extrusions or sheets of AA 6000 series wrought aluminum alloys. The molten aluminum alloy may be an Al-Mg-Si casting aluminum alloy.

DETAILED DESCRIPTION OF THE INVENTION

The present invention includes a process for joining aluminum components. This process provides for joining of a component, such as a cast component (casting), an extruded member (extrusion) and sheet product, by directly casting a cast member in place onto the component. A cast joint reduces the cost associated with producing large aluminum structural assemblies. The components joined by cast joining may be made to less stringent tolerances, thereby eliminating the machining operations used to guarantee consistent fit and welds gaps. Costly assembly fixtures and other equipment such as welding power sources are not necessary. The labor of conventional welding processes is greatly reduced. In addition, the cast joining process of the present invention enables joints to be formed at locations where welding and other prior techniques are difficult to achieve.

The present invention includes the steps of 1) coating at least one surface of an aluminum alloy component with flux, 2) placing the flux coated component in a mold, 3) filling the mold with molten aluminum alloy and 4) allowing the molten metal to solidify whereby the molten metal solidifies as a casting on the component. The flux distributes itself closely between the surface of the component and metal to be joined, typically via capillary action. The liquidus of the flux is preferably less than the solidus of the metal of the component being joined. The flux removes oxides on the surface of the component and oxygen in the atmosphere adjacent the surfaces being joined. Hence, the flux must begin to melt at a temperature low enough to minimize oxidation of the parts be essentially molten at the time that the molten metal contacts the component to be joined, flow over both the surface to be joined and the molten metal to shield the component and the molten metal from oxidation, penetrate oxide films present on the component to be joined, and lower the surface tension between the solid metal of the component and the liquid (molten) metal to promote wetting.

The flux used in the present invention is preferably non-corrosive, non-hygroscopic, and generates minimal fumes during cast joining. A preferred flux for practicing the method of the present invention is a cesium fluoride composition. The flux preferably includes CsF, $AlF_3$, and $Al_2O_3$, more preferably, about 60 wt. % CsF, about 30 wt. % $AlF_3$ and about 10 wt. % $Al_2O_3$.

The flux of the present invention may be provided in a carrier such as water or alcohol and may be applied by dipping, brushing, spraying, or the like. The flux is preferably coated on the surface to be joined in a thickness of about 5 to 20 g/m$^2$. Preferably, the surface of the component to be joined is roughened, such as by shot blasting, glass bead blasting, and cleaning with a wire brush. The surface may also be cleaned with a mild caustic etch solution and washed with acetone.

Components which may be joined via the method of the present invention may be formed from a metal which has a solidus above the liquidus of the molten (casting) metal. Suitable metals for the components to be joined include aluminum alloys such as aluminum Association (AA) alloys of the 6000 series, preferably AA 6061. The solidus of AA 6061 is 1140° F., and the liquidus of AA 6061 is 1205° F. The molten metal may be a casting alloy containing Al, Mg and Si, preferably AA A356. The solidus of AA A356 is 1007° F., and the liquidus of A356 is 1135° F.

Although the invention has been described generally above, the particular examples give additional illustration of the product and process steps typical of the present invention.

EXAMPLES

Example 1

Extrusions of AA 6061 tube with 1 inch outside diameter and ⅛ inch thick wall where coated with a flux containing about 60 wt. % CsF, about 30 wt. % $AlF_3$, and about 10 wt. % $Al_2O_3$ and placed in sand molds each having a cavity for forming a circular flange on the extrusion. Molten casting alloy A356 was injected into the molds and allowed to solidify to form a circular flange on the exterior of the extrusion. Tensile test evaluations were made of the joint between each extrusion and flange. The strength of the cast joints was compared to two flange castings TIG welded onto an extrusion. The assemblies were bolted to a fixture on the lower side of a tensile test machine and held in grips on the upper side of the machine. All assemblies were pulled until failure. All failures occurred in the extrusion. None of the cast joints pulled apart. The tensile strength of the extrusion at the failure was in line with the properties for the welded assemblies (samples 7 and 8) as set forth in Table 1.

TABLE 1

Ultimate Tensile Test (Sand Cast Joints)

| SAMPLE | LOAD (lbs.) | AREA (sq. in.) | UTS (ksi) | UTS (Mpa) |
|---|---|---|---|---|
| 1 | 4900 | 0.345 | 14.26 | 98.33 |
| 2 | 4872 | 0.345 | 14.18 | 97.77 |
| 3 | 4854 | 0.345 | 14.13 | 97.43 |
| 4 | 4766 | 0.345 | 13.87 | 95.64 |
| 5 | 4736 | 0.345 | 13.78 | 95.02 |
| 6 | 4640 | 0.345 | 13.50 | 93.09 |
| 7 (welded) | 5540 | 0.345 | 16.12 | 111.15 |
| 8 (welded) | 7764 | 0.345 | 22.60 | 155.83 |

The extrusions of the two welded samples (examples 7 and 8) exhibited higher ultimate tensile strengths than the extrusions of the cast joined samples (1–6), and this is believed to be due to the impact of heat on the extrusion during casting.

Example 2

An extrusion of 2.5 inches outside diameter AA. alloy 6061 with ¼ inch wall thickness was stainless steel shot-blasted. Flux containing about 60 wt. % CsF, about 30 wt. % $AlF_3$, and about 10 wt. % $Al_2O_3$ was brushed on the extrusion and allowed to dry. The flux coated extrusion was placed in a permanent mold. The permanent mold defined a rectangular flange casting cavity surrounding a cylindrical extrusion. Molten casting alloy A356 was injected into the mold and allowed to solidify to form a rectangular flange (6 inches wide, 4.75 inches long, 0.625 inch thick) on the exterior of the extrusion with a cylindrical section (0.25 inch thick wall) extending from the rectangular flange and surrounding the extrusion.

The dendrite arm spacing (DAS) of two samples each from four different castings were evaluated. One sample was taken at random in an area with good metallurgical bond and one sample was taken from an area with no metallurgical bond. Large DAS (average 27.7 microns) was evident in areas with good metallurgical bonds and smaller DAS average 14.8) was found in the areas where there was no bond as set forth in Table 2. The smallest DAS noted in the bonded area was 22.67 microns and the larger DAS in a no bond area was 16.03 microns.

TABLE 2

Dendrite Aim Spacing vs. Bond or No Bond

| SAMPLE I.D. | BOND/NO BOND | DAS (MICRONS) |
|---|---|---|
| 920 1 | No Bond | 16.03 |
| 920 3 | Bond | 32.39 |
| 931 2 | Bond | 27.00 |
| 931 3 | No Bond | 14.01 |
| 939 1 | No Bond | 14.68 |
| 939 5 | Bond | 28.70 |
| 954 2 | Bond | 22.67 |
| 954 8 | No Bond | 14.50 |

The solidus and liquidus of both the extrusion alloy and the casting alloy as well as the melting temperature of the flux are critical to the cast joining process of the present invention. The brazing temperature is preferably about 70° F. less than the solidus temperature of the metal component. For example, the temperature of an extrusion of AA 6061 should be about 1070° F. and the temperature of the casting of A356 should be in excess of 1135° F. for ideal bonding conditions. If the cast metal is greater than 1140° F., the threat of melting the AA 6061 extrusions exists. The temperature of the molten cast metal lowers as the molten metal enters and fills the mold. On the other hand, the temperature of the extrusion increases as the mold is filling. As the temperature of the cast metal drops, the percentage of solid increases and if the temperature is too low, no bounding will take place.

The amount of flux is also important for achieving good cast joining. Excess flux results in a line of gas porosity at the interface between the casting and the extrusion. A flux layer of about 5–20 $g/m^2$ thick is preferred. Excess oxygen will consume the flux, therefore, flux usage may depend to a degree on casting and mold design. Application of flux to a rough surface finish can result in excess flux.

It will be readily appreciated by those skilled in the art that modifications may be made to the invention without departing from the concepts disclosed in the foregoing description. Such modifications are to be considered as included within the following claims unless the claims, by their language, expressly state otherwise.

Accordingly, the particular embodiments described in detail herein are illustrative only and are not limiting to the scope of the invention which is to be given the full breadth of the appended claims and any and all equivalents thereof.

We claim:

1. A method of joining an aluminum cast member to an aluminum component consisting essentially of the steps of:

coating a surface of an aluminum component with flux comprising cesium fluoride;

placing the flux coated component in a mold;

filling the mold with molten aluminum alloy, whereby the flux lowers the surface tension between the molten aluminum alloy and the aluminum component; and allowing the molten aluminum alloy to solidify thereby joining a cast member to the aluminum component.

2. The method of claim 1 wherein the flux further comprises aluminum fluoride and alumina.

3. The method of claim 2 wherein the flux comprises about 60 wt. % CsF, about 30 wt. % $AlF_3$, and about 10 wt. % $Al_2O_3$.

4. The method of claim 1 wherein the surface of the component to be coated with flux is roughened.

5. The method of claim 1 wherein the aluminum component comprises an AA 6000 series aluminum alloy.

6. The method of claim 5 wherein the aluminum component comprises AA 6061.

7. The method of claim 1 wherein the molten aluminum alloy component comprises a casting alloy comprising Al, Mg and Si.

8. The method of claim 7 wherein the casting alloy comprises AA A356.

9. The method of claim 1 wherein the aluminum component comprises an extrusion, a casting or a sheet product.

10. The method of claim 1 wherein the flux is preferably coated on the surface in an amount of about 5 to 20 $g/m^2$.

* * * * *